US007932872B2

(12) United States Patent
Yamamoto et al.

(10) Patent No.: US 7,932,872 B2
(45) Date of Patent: Apr. 26, 2011

(54) PICTURE DISPLAYING METHOD, SYSTEM AND UNIT

(75) Inventors: Ryuya Yamamoto, Kawasaki (JP); Hisashi Yamaguchi, Kawasaki (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 836 days.

(21) Appl. No.: 11/509,573

(22) Filed: Aug. 25, 2006

(65) Prior Publication Data

US 2007/0097018 A1 May 3, 2007

(30) Foreign Application Priority Data

Aug. 26, 2005 (JP) ..... 2005-245583
Aug. 8, 2006 (JP) ..... 2006-215361

(51) Int. Cl.
*G09G 5/00* (2006.01)

(52) U.S. Cl. ..... 345/1.3; 345/1.1; 345/1.2; 345/2.1; 345/3.1; 345/4

(58) Field of Classification Search ..... 345/1.3
See application file for complete search history.

(56) References Cited

U.S. PATENT DOCUMENTS

2004/0008155 A1* 1/2004 Cok ..... 345/1.3
2004/0233125 A1* 11/2004 Tanghe et al. ..... 345/1.3

FOREIGN PATENT DOCUMENTS

JP 5-80714 A 4/1993
JP 5080714 * 4/1993
JP 9-62230 A 3/1997
JP 9062230 * 3/1997

* cited by examiner

*Primary Examiner* — Bipin Shalwala
*Assistant Examiner* — Kelly Hegarty
(74) *Attorney, Agent, or Firm* — Sughrue Mion, PLLC

(57) ABSTRACT

A picture displaying method is for displaying a picture by means of a plurality of picture displaying units. A picture signal representing the picture is supplied to each of the picture displaying units. A first picture displaying unit displays a first part of the picture according to the picture signal and produces a start pulse signal after displaying of the first part of the picture. A second picture displaying unit displays a second part of the picture according to the picture signal in response to the start pulse signal.

18 Claims, 6 Drawing Sheets

PICTURE DISPLAYING METHOD, SYSTEM AND UNIT

This application claims priority to prior applications JP 2005-245583 and JP 2006-215361, the disclosures of which are incorporated herein by reference.

BACKGROUND OF THE INVENTION

This invention relates to a flat panel display unit and to picture displaying by the use thereof, in particular, to picture displaying by means of a plurality of flat panel display units.

For displaying different pictures with a plurality of liquid crystal display units, it is necessary to provide the same number of signal sources as the liquid crystal display units. For instance, the same number of graphic boards, each of which has a picture signal output, as the liquid crystal display units is used as the signal sources. Alternatively, a graphic board having the same number of picture signal outputs as the liquid crystal display units is used as the signal sources.

Moreover, there is a liquid crystal display unit that a liquid crystal display panel thereof can display two different pictures at a time by dividing a screen. The liquid crystal display unit has also two image signal sources. Such a display unit is disclosed in Japanese Patent Unexamined Publication No. 9-62230.

On the other hand, it is known that a liquid crystal display unit has two pairs of drivers to drive a liquid crystal panel and to display a picture. The liquid crystal display unit simultaneously scans two areas of the liquid crystal panel. Therefore, the liquid crystal display unit needs two signal sources. Such a display unit is disclosed in Japanese Patent Unexamined Publication No. 5-80714.

At any rate, the liquid crystal display unit needs the same number of signal sources as pictures which would be displayed. That is, it is currently impossible that one of two liquid crystal display units displays an upper/left half of a picture according to a picture signal while the other displays a lower/right half of the picture according to the same picture signal. Furthermore, it is currently impossible that one of two liquid crystal display units displays a picture according to a picture signal while the other displays another picture according to the same picture signal. This is true of the liquid crystal display unit which has liquid crystal display panel divided into two areas.

SUMMARY OF THE INVENTION

It is therefore an object of this invention to provide a method that a plurality of picture displaying units, each of which displays a part of a picture, displays the whole of the picture according to a single picture signal without the same number of signal sources, such as graphic boards, as the picture displaying units.

Other objects of this invention will become clear as the description proceeds.

According to a first aspect of this invention, a picture displaying method is for displaying a picture by means of a plurality of picture displaying units each of which has a displaying panel driven with primary and secondary driving signals produced according to an input picture signal. The picture displaying method comprises the steps of supplying the input picture signal to each of the picture displaying units; starting, in a first displaying unit which is one of the picture displaying units, producing first primary and first secondary driving signals according to the input picture signal; starting, in a second displaying unit which is another one of the picture displaying units, producing one of second primary and second secondary driving signals according to the input picture signal; driving a first displaying panel of the first displaying unit with the first primary and the first secondary driving signals to display a first part of the picture represented by the input picture signal; sending a start pulse signal produced by the first displaying unit to the second displaying unit after displaying the first part of the picture; starting, in the second displaying unit, producing the other of the second primary and the second secondary driving signals in response to the start pulse signal; and driving a second displaying panel of the second displaying unit with the second primary and the second secondary driving signals to display a second part, which is different from the first part, of the picture represented by the input picture signal.

According to a second aspect of this invention, a picture displaying system comprises a plurality of picture displaying units each of which has a displaying panel driven with primary and secondary driving signals produced according to an input picture signal. The input picture signal is supplied to each of the picture displaying units. A first picture displaying unit which is one of the picture displaying units starts producing first primary and first secondary driving signals according to the input picture signal, drives a first displaying panel thereof with the first primary and the first secondary driving signals to display a first part of a picture represented by the input picture signal, and then sends a start pulse signal to a second picture displaying unit which is another one of the picture displaying units. The second picture displaying unit starts producing one of second primary and second secondary driving signals according to the input picture signal, and starts producing the other of the second primary and the second secondary driving signals according to the picture signal in response to the start pulse signal, and drives a second displaying panel thereof with the second primary and the second secondary driving signals to display a second part, which is different from the first part, of the picture represented by the input picture signal.

According to a third aspect of this invention, a picture displaying unit comprises a start pulse signal producing circuit for producing start pulse signals to start producing first primary and first secondary driving signals according to an input picture signal. Primary and secondary driver circuits are for producing the first primary and the first secondary driving signals in response to the start pulse signals. A displaying panel is for being driven with the first primary and the first secondary driving signals. The primary driver circuit sends an additional start pulse signal to another picture displaying unit which receives the input picture signal to start producing one of second primary and second secondary driving signals after producing the first primary driving signal. The displaying panel displays a part of a picture represented by the input picture signal.

According to a fourth aspect of this invention, a picture displaying unit comprises a start pulse signal producing circuit for producing an internal start pulse signal to start producing primary driving signals according to an input picture signal. A primary driver circuit is for producing the primary driving signal in response to the internal start pulse signal. A secondary driver circuit is for receiving an external start pulse signal from the outside to produce the secondary driving signal. A displaying panel is driven with the primary and the secondary driving signals for displaying a part of a picture represented by the input picture signal.

According to a fifth aspect of this invention, a picture displaying unit comprises a start pulse signal producing circuit for producing an internal start pulse signal to start producing a primary driving signal according to an input picture signal. A primary driver circuit is for producing the primary driving signal in response to the internal start pulse signal. A secondary driver circuit is for receiving an external start pulse signal from a preceding picture displaying unit to produce a secondary driving signal. The secondary driver circuit produces another external start pulse signal to be supplied to a following picture displaying unit. A displaying panel is driven with the primary and the secondary driving signals to display a part of a picture represented by the input picture signal.

According to a sixth aspect of this invention, a picture displaying method is for displaying a picture represented by a picture signal by means of a plurality of picture displaying units. The picture displaying method comprises the steps of: supplying the input picture signal to each of the picture displaying units; displaying a first part of the picture according to the picture signal by means of a first picture displaying unit which is one of the picture displaying units; sending a start signal from the first picture displaying unit to a second picture displaying unit which is another one of the picture displaying units after displaying of the first part of the picture; and displaying a second part different from the first part of the picture according to the picture signal in response to the start signal by means of the second picture displaying unit.

According to a seventh aspect of this invention, a picture displaying system is for displaying a picture represented by a picture signal. The system comprises a first picture displaying unit for receiving the picture signal to display a first part of the picture and to produce a start signal after displaying the first part of the picture. A second picture displaying unit is for receiving both of the picture signal and the start signal to display a second part different form the first part of the picture.

DESCRIPTION OF THE PREFERRED EMBODIMENTS

Figure 1:
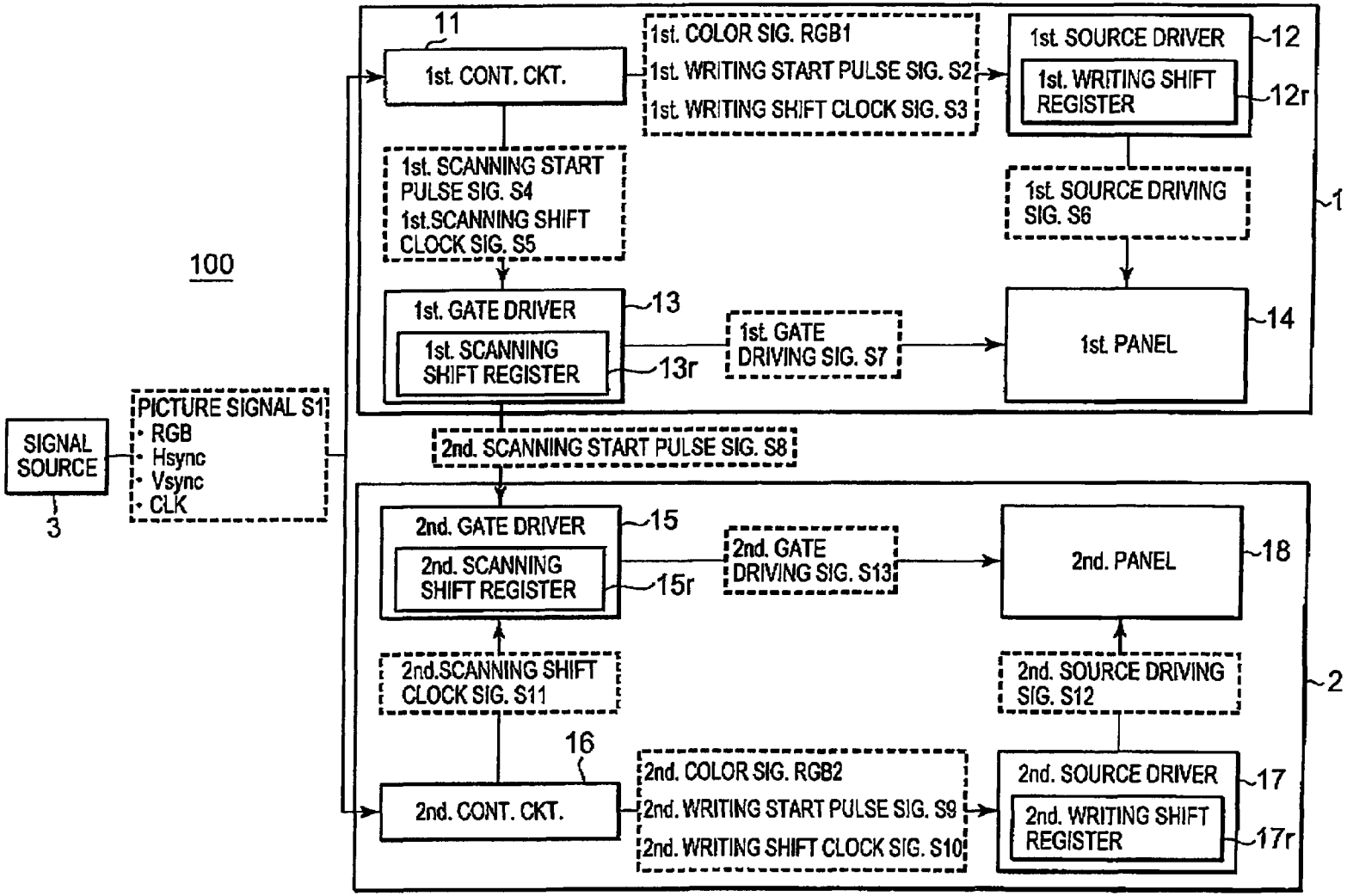
FIG. 1 is a block diagram of a picture displaying system according to a first embodiment of this invention.

Referring to FIG. 1, a description will be made about a picture displaying system 100 according to a first embodiment of this invention.

The picture displaying system 100 includes first and second liquid crystal display units 1 and 2 and a signal source 3.

The first and the second liquid crystal display units 1 and 2 display different pictures according to a common picture signal S1 supplied from the signal source 3.

The signal source 3 produces the picture signal S1. The signal source 3, for example, is a video card for a computer. The picture signal S1, for example, includes color signals RGB, a horizontal synchronization signal Hsync, a vertical synchronization signal Vsync and a dot clock signal CLK. The picture signal S1 includes a picture frame which represents a picture having 2n (n: a natural number) of scanning lines each of which corresponds to m (m: a natural number) of pixels. Alternatively, the picture frame represents two successive pictures each of which has n of scanning lines. A conventional liquid crystal display unit needs a liquid crystal display panel with at least 2n of gate lines to display the picture having 2n of the scanning lines.

The first liquid crystal display unit 1 includes a first control circuit 11, a first source driver 12, a first gate driver 13 and a first panel 14. The first panel 14 is a TFT (or active matrix type) liquid crystal panel having m (m: a natural number) of source lines and n of gate lines (G1, G2, . . . , Gn). The first source driver 12 has a first writing shift register 12*r* having the same number (=m) of stages (e.g. flip-flops) as the source lines of the first panel 14. The first gate driver 13 has a first scanning shift register 13*r* having the same number (=n) of stages (e.g. flip-flops) as the gate lines of the first panel 14.

Similarly, the second liquid crystal display unit 2 includes a second control circuit 16, a second source driver 17, a second gate driver 15 and a second panel 18. The second panel 18 similar to the first panel 14. That is, the second panel 18 is a TFT (or active matrix type) liquid crystal panel having m (m: a natural number) of source lines and n (n: a natural number) of gate lines (Gn+1, Gn+2, . . . , Gn+n). The second source driver 17 has a second writing shift register 17*r* having the same number (=m) of stages as the source lines of the second panel 18. The second gate driver 15 has a second scanning shift register 15*r* having the same number (=n) of stages as the gate lines of the second panel 18.

The first liquid crystal display unit 1 operates as follows.

On receiving the picture signal S1 from the signal source 3, the first control circuit 11 passes the color signals RGB included in the picture signal S1 to the first source driver 12 as a first color signal RGB1. Furthermore, the first control circuit 11 produces a first writing start pulse signal S2, a first writing shift clock signal S3, a first scanning start pulse signal S4 and a first scanning shift clock signal S5. These signals s2-S5 are produced by using the horizontal synchronization signal Hsync, the vertical synchronization signal Vsync and/or the dot clock signal CLK. The first writing start pulse signal S2 and the first writing shift clock signal 83 are supplied to the first source driver 12 while the first scanning start pulse signal S4 and the first scanning shift clock signal 85 are supplied to the first gate driver 13.

In the first source driver 12, the first writing start pulse signal S2 from the first control circuit 11 is supplied to the first writing shift register 12*r*. The first writing shift register 12*r* shifts and outputs the first writing start pulse signal S2 in response to the first writing shift clock signal S3. One of the source lines of the first panel 14 is specified according to the stage of the first writing shift register 12*r* that outputs the first writing start pulse signal S2. The first source driver 12 performs sampling of the color signal RGB1 in response to the output of the first writing shift register 12*r*. Subsequently the first source driver 12 performs D-A conversion of the sampled color signal to produce a first source driving signal S6. The first source driving signal S6 is supplied from the first source driver 12 to the specified source line of the first panel 14. Thus, the source lines of the first panel 14 are driven by the first source driving signal S6 in order. Thus, the source lines of the first panel are driven by the first source driving signal one by one.

On the other hand, in the first gate driver 13, the first scanning start pulse signal S4 from the first control circuit 11 is supplied to the first scanning shift register 13*r*. The first scanning shift register 13*r* shifts and outputs the first scanning start pulse signal S4 in response to the first scanning shift clock signal S5. One of the gate lines G1-Gn of the first panel 14 is specified according to the stage of the first scanning shift register 13*r* that outputs the first scanning start pulse signal S4. The first gate driver 13 converts the output of the shift register 13*r* into an ON voltage of a TFT level and supplies it to the specified gate line of the first panel 14 as a first gate driving signal S7. As a result, the gate lines G1-Gn are supplied with the ON voltage one by one according to the first scanning shift clock signal S4.

The first gate driver 13 further supplies a second scanning start pulse signal 88 to the second gate driver 15, after the ON voltage is supplied to the nth gate line of the first panel 14.

The first panel 14 receives the first source driving signal S6 from the first source driver 12 and the first gate driving signal S7 from the first gate driver 13. The first panel 14 selects the gate lines one by one according to the first gate driving signal S7. While each gate line is selected, the first panel 14 writes the first source driving signal S6 to the source lines thereof in turn.

The second control circuit 16 receives the picture signal S1 from the signal source 3 and passes the color signals RGB included in the picture signal S1 to the second source driver 17 as a second color signal RGB2. Furthermore, the second control circuit 16 produces a second writing start pulse signal 89, a second writing shift clock signal S10 and a second scanning shift clock signal S11 according to the picture signal S1. The second writing start pulse signal S9 and the second writing shift clock signal S10 are supplied to the second source driver 17 while the second scanning shift clock signal S1 is supplied to the second gate driver 15. The second control circuit 16 does not supply a start pulse signal to the second gate driver 15 differently from the first control circuit 11. The second color signal RGB2, the second writing start pulse signal S9, the second writing shift clock signal S10 and the second scanning shift clock signal S11 are identical to the first color signal RGB1, the first writing start pulse signal S2, the first writing shift clock signal S3 and the first scanning shift clock signal S5, respectively.

In the second source driver 17, the second writing start pulse signal S9 from the second control circuit 16 is supplied to the second writing shift register 17*r*. The second writing shift register 17*r* shifts and outputs the second writing start pulse signal S9 in response to the second writing shift clock signal S10. One of the source lines of the second panel 18 is specified according to the stage of the second writing shift register 17*r* that outputs the second writing start pulse signal S9. The second source driver 17 performs sampling of the second color signal RGB2 in response to the output of the second writing shift register 17*r*. Subsequently the second source driver 17 performs D-A conversion of the sampled color signal to produce a second source driving signal S12. The second source driving signal S12 is supplied from the second source driver 17 to the specified source line of the second panel 18. The second source driving signal 812 is identical to the first source driving signal S6.

On the other hand, in the second gate driver 15, the second scanning start pulse signal S8 from the first gate driver 13 is supplied to the second scanning shift register 15*r*. The second scanning shift register 15*r* shifts and outputs the second scanning start pulse signal S8 in response to the second scanning shift clock signal S11. One of the gate lines Gn+1-Gn+n of the second panel 18 is specified according to the stage of the second scanning shift register 15*r* that outputs the second scanning start pulse signal S9. The second gate driver 15 converts the output of the second scanning shift register 15*r* into ON voltage of the TFT level and supplies it to the specified gate line of the second panel 18 as a second gate driving signal S13. As a result, the gate lines Gn+1-Gn+n are supplied with the ON voltage one by one according to the second scanning shift clock signal S11 after the second scanning start pulse signal S8 is supplied from the first gate driver 13 to the second gate driver 15.

The second panel 18 receives the second source driving signal 812 from the second source driver 17 and the second gate driving signal S13 from the second gate driver 15. The second panel 18 selects the gate lines one by one according to the second gate driving signal S13. While each gate line is selected, the second panel 18 writes the second source driving signal S12 to the source lines thereof in turn.

Figure 2:
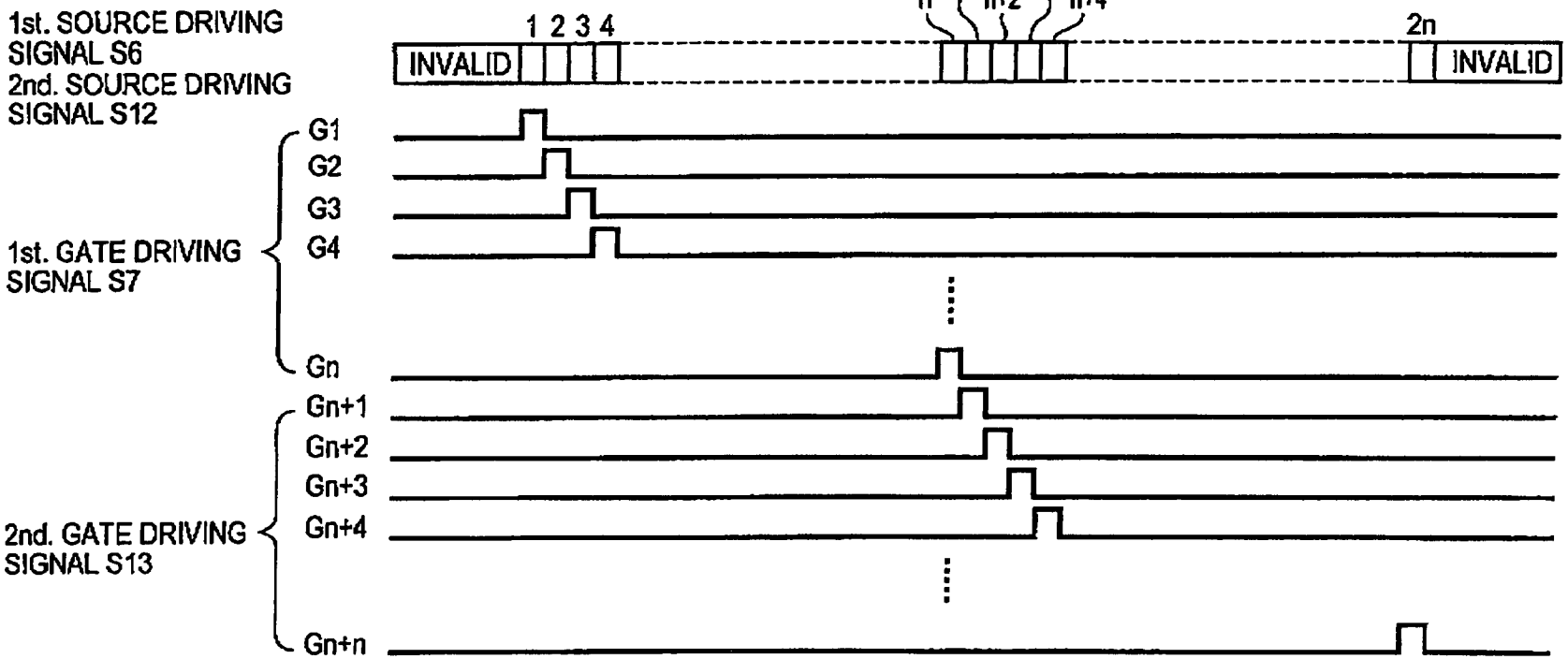
FIG. 2 is a time chart of source driving signals and gate driving signals in the picture displaying system of FIG. 1.

FIG. 2 shows a timing chart of the driving signals S6, S7, S12 and S13 in the picture displaying system 100.

As mentioned above, the picture signal S1 has the picture frame having 2n of the scanning lines. A first half, from the first scanning line to the nth scanning line, of the picture frame is displayed by the first panel 14 while a latter half, from the n+1th scanning line to the 2 nth scanning line, of the picture frame is displayed by the second panel 18.

The scanning start pulse signal S4 registered in the first scanning shift register 13*r* is sifted in response to the first scanning shift clock pulse signal S5, and thereby the first gate driving signal S7 is supplied to the gate lines G1, G2, . . . , Gn of the first panel 14 in turn. At the same time, the first source driving signal S6 is supplied to the first panel 14 in response to the first writing shift clock signal S3. Thus, the first to the nth scanning lines are displayed on the first panel 14.

After production of the first gate driving signal S7 for the nth gate line, the first gate driver 13 produces the second scanning start pulse signal 88 to supply it to the second gate driver 15.

The second scanning start pulse signal S8 is registered in the second scanning shift register 15*r* and shifted in response to the second scanning shift clock signal S11. As a result, the second gate driving signal 813 is supplied to the gate lines Gn+1, Gn+2, . . . , Gn+n of the second panel 18 in turn. At the same time, the second source driving signal S12 is supplied to the second panel 14 in response to the second writing shift clock signal S10. Thus, the n+1th to the 2 nth scanning lines are displayed on the second panel 18.

As mentioned above, the former n of the scanning lines included in the picture frame of the picture signal S1 are displayed on the first panel 14 while the latter n of the scanning lines are displayed on the second panel 18. Thus, the displaying system can display different pictures (or areas of a picture) without providing the same number of the signal sources such as graphic boards as the picture displaying units.

Figure 3:
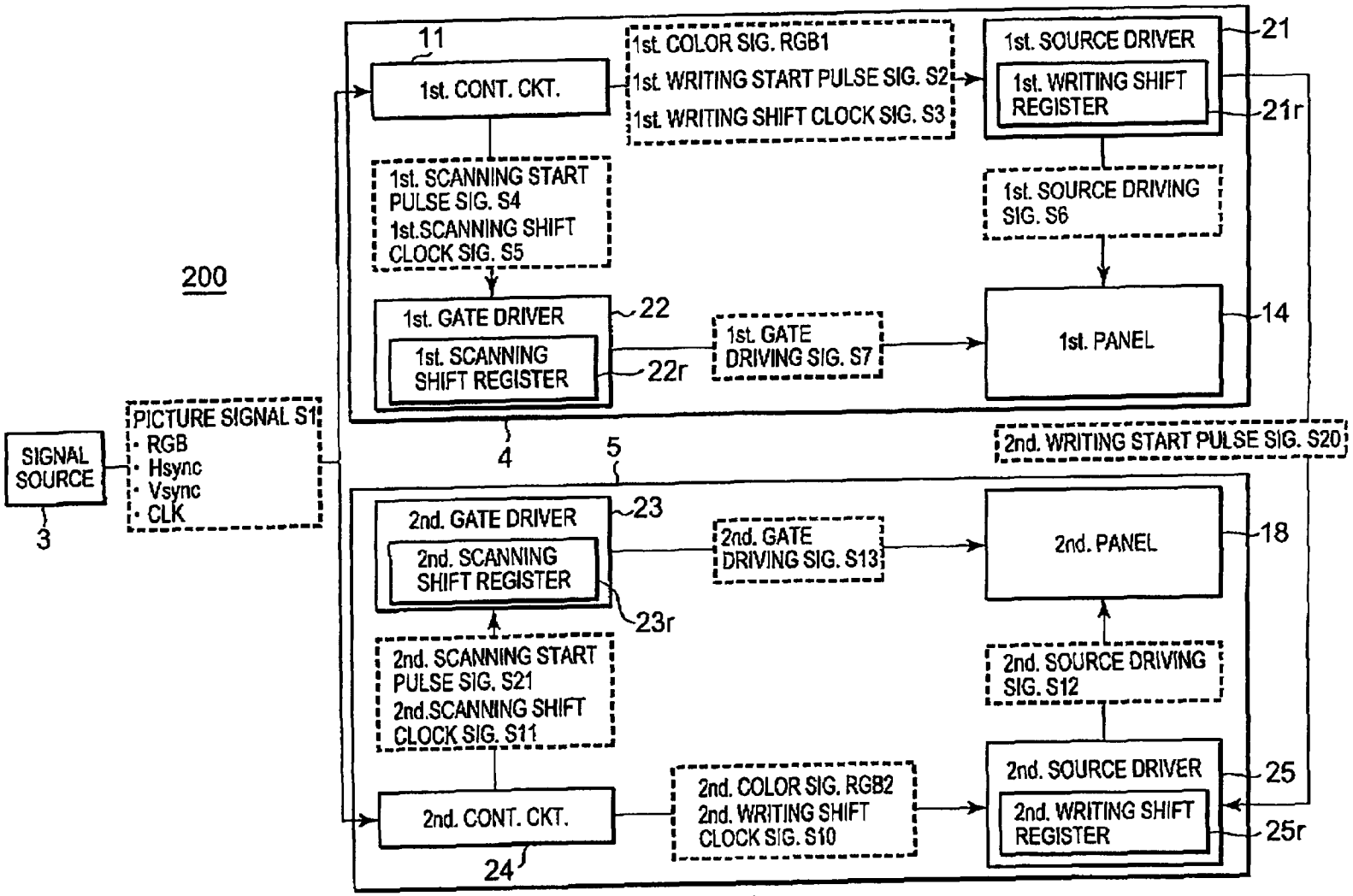
FIG. 3 is a block diagram of a picture displaying system according to a second embodiment of this invention.

Referring to FIG. 3, the description is directed to a picture displaying system 200 according to a second embodiment of this invention. The parts similar to those of FIG. 1 are designated by similar reference numerals. In this embodiment, the picture frame of the picture signal S1 has n of the scanning lines each of which corresponds to 2m of the pixels.

The picture displaying system 200 has liquid crystal displaying units 4 and 5 which are different from the units 1 and 2 of FIG. 1. Particularly, a first source driver 21, a first gate driver 22, a second gate driver 23, a second control circuit 24 and a second source driver 25 are different in function from those in the units 1 and 2.

The first source driver 21 includes a first writing shift register 21*r* which has the same number (=m) of stages as the source lines of the first panel 14. The first writing start pulse signal S2 output from the first control circuit 11 is supplied to the first writing shift register 21*r*. The first writing shift register 21*r* shifts and outputs the first writing start pulse signal S2 in response to the first writing shift clock signal 83. One of the source lines of the first panel 14 is specified according to the stage of the first writing shift register 21*r* that outputs the first writing start pulse signal 82. The first source driver 21 performs sampling of the first color signal RGB1 in response to the output of first writing shift register 21*r*. Subsequently, the first source driver 21 performs D-A conversion of the sampled color signal to produce the first source driving signal S6. The first source driving signal S6 is supplied from the first source driver 21 to the specified source line of the first panel 14.

The first source driver 21 further supplies a second writing start pulse signal S20 to the second source driver 25 after it receives the shift clock signal S3 for the number of the source lines of the first panel 14. That is, the first source driver 21 supplies the second writing start pulse signal S20 to the second source driver 25 when the first source driving signal S6 is supplied to the mth source line of the first panel 14.

The first gate driver 22 is different from the first gate driver 13 of FIG. 1 in that it does not produce the second scanning start pulse signal S8. Otherwise, the first gate driver 22 is similar to the first gate driver 13 of FIG. 1.

The second gate driver 23 includes a second scanning shift register 23*r* having the same number (=n) of stages as the gate lines Gn+1-Gn+n of the second panel 18. The second scanning shift register 23*r* receives a second scanning start pulse signal S21 and the second scanning shift clock signal S11 from the second control circuit 24. The second scanning shift register 23*r* shifts the second scanning start pulse signal S21 in response to the second scanning shift clock signal S11. The second gate driver 23 converts the output of the second scanning shift register 23*r* into the ON voltage of the TFT level. The ON voltage is supplied to the specified gate line as the second gate driving signal S13. The second gate driving signal S13 is identical to the first gate driving signal S7.

The second control circuit 24 receives the picture signal S1 and passes the color signals RGB included in the picture signal S1 to the second source driver 25 as a second color signal RGB2. The second control circuit 24 further produces a second writing shift clock signal S10, the second scanning signal clock signal S11 and the second scanning start pulse signal S21. The second writing shift clock signal S10 is supplied to the second source driver 25, The second scanning start pulse signal S21 and the second scanning shift clock signal S11 are supplied to the second gate driver 23 as mentioned above. It will be noticed that the second control circuit 24 does not produces the second writing start pulse signal S9 differently from that of FIG. 1.

The second source driver 25 includes a second writing shift register 25*r* which has the same number (=m) of stages as the source lines of the second panel 18 like the first writing shift register 21*r*. The second writing start pulse signal S20 output from the first source driver 21 is supplied to the second writing shift register 25*r*. The second writing shift register 25*r* shifts and outputs the second writing start pulse signal S20 in response to the second writing shift clock signal S10 supplied from the second control circuit 24. One of the source lines of the second panel 18 is specified according to the stage of the second writing shift register 25*r* that outputs the second writing start pulse signal S20. The second source driver 25 performs sampling of the second color signal RGB2 in response to the output of second writing shift register 25*r*. Subsequently, the second source driver 25 performs D-A conversion of the sampled color signal to produce the second source driving signal S12. The second source driving signal S12 is supplied from the second source driver 25 to the specified source line of the second panel 18.

Figure 4:
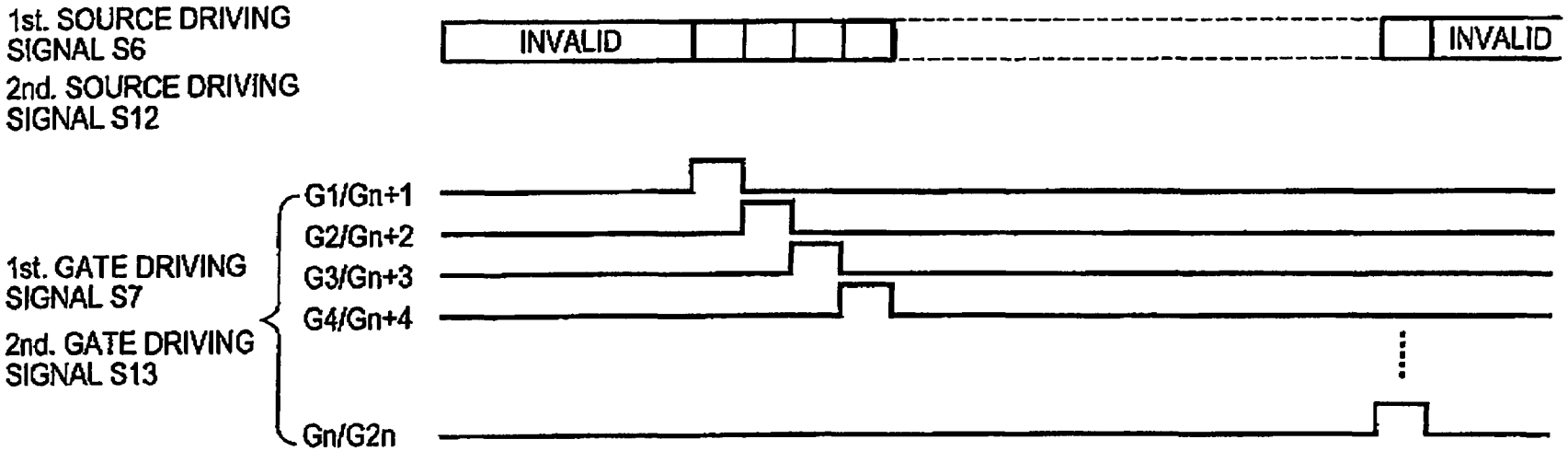
FIG. 4 is a time chart of source driving signals and gate driving signals in the picture displaying system of FIG. 3.

FIG. 4 shows a timing chart of the driving signals S6, S7, S12 and S13 in the picture displaying system 200. As mentioned above, the first source driver 21 supplies the start pulse S20 to the second source driver 25 after it receives the shift clock signal S3 for the number of the source lines of the first panel 14. The second source driver 25 operates like the second driver 17 of the first embodiment except for a source of the start pulse signal, Then, the picture displaying system 200 draws a first half of each scanning line on the first panel 14. A latter half of each scanning line is drawn on the second panel 18. As a result, a left half of the picture frame is displayed on the first panel 14 while a right half of the picture frame is displayed on the second panel 18.

Thus, the displaying system can display different pictures (or areas of a picture) like that of the first embodiment without providing the same number of the signal sources such as graphic boards as the picture displaying units.

While this invention has thus far been described in conjunction with the preferred embodiments thereof, it will readily be possible for those skilled in the art to put this invention into practice in various other manners.

For example, three or more liquid crystal units may be used in a picture displaying system though each of the systems 100 and 200 has two units 1 and 2 or 4 and 5. Specifically, one or more liquid crystal display unit(s) 6 shown in FIG. 5 may be disposed between the liquid crystal displaying units 1 and 2 of FIG. 1 to configure a picture displaying system 300. Alternatively, one or more liquid crystal display unit(s) 7 shown in FIG. 6 may be disposed between the liquid crystal display units 4 and 5 of FIG. 3 to configure a picture displaying system 400.

The size of each panel of the picture displaying system 300 or 400 depend on the number of the liquid crystal units and the number of pixels of the picture frame. If the number of the liquid crystal units is equal to l (l: an integer equal to or larger than three) and the number of the pixels of the picture frame is equal to m×n (m, n: natural numbers), each panel of the system 300 has n of gate lines and m/l of source lines. On the same assumption, each panel of the system 400 has n/l of gate lines and m of source lines.

Figure 5:
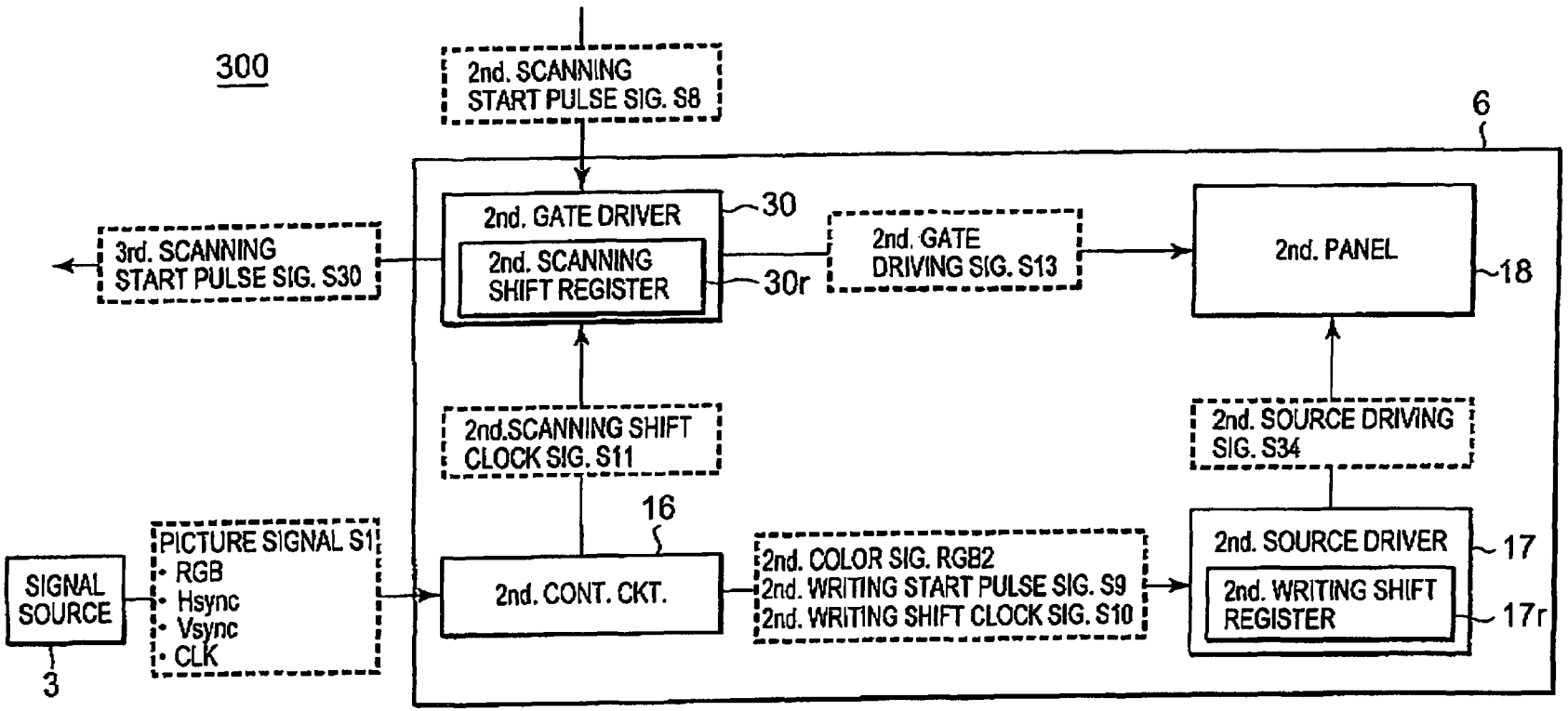
FIG. 5 is a block diagram of a picture displaying unit according to another embodiment of this invention.

In FIG. 5, the liquid crystal display unit 6 is similar to the liquid crystal display unit 2 of FIG. 1 except for providing a second gate driver 30 in place of the second gate driver 15.

The second gate driver 30 of FIG. 5 receives the second scanning start pulse signal S8 from the first gate driver 13 to operate like the second gate driver 15 of FIG. 1. Furthermore, the second gate driver 30 produces a third scanning start pulse signal S30 after the second gate driving signal S13 is supplied to the last (e.g. nth) gate line of the second panel 18. The third scanning start pulse signal S30 is supplies to the following liquid crystal display unit (6 or 2). The following liquid crystal display unit receives the third scanning start pulse signal S30 instead of the second scanning start pulse signal s8 and operates as mentioned above regarding the liquid crystal displaying unit 2 or 6.

Figure 6:
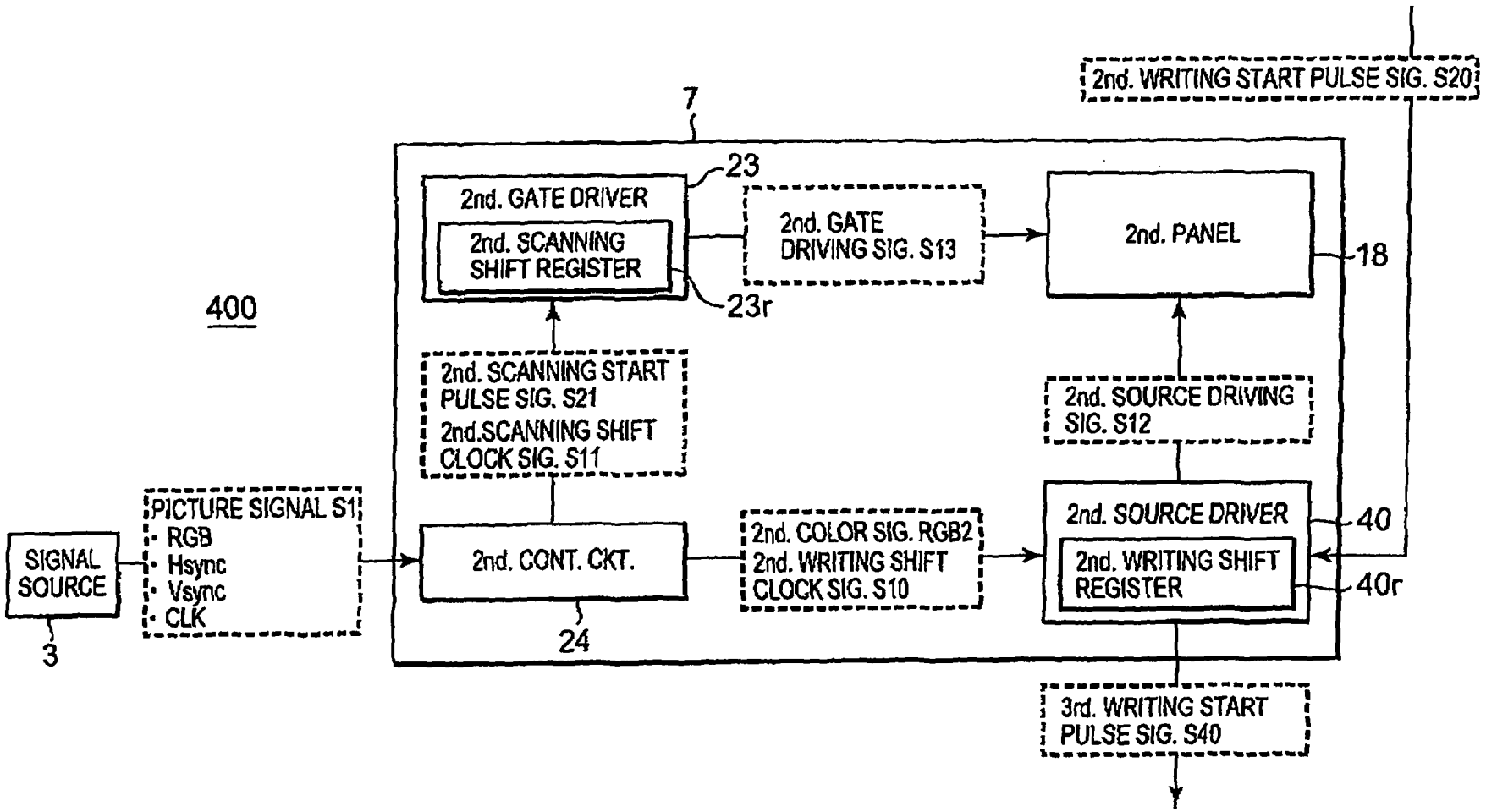
FIG. 6 is a block diagram of a picture displaying unit according to still another embodiment of this invention.

In FIG. 6, the liquid crystal display unit 7 is similar to the liquid crystal display unit 5 except for providing a second source driver 40 in place of the second source driver 17.

The second source driver 40 of FIG. 6 receives the second writing start pulse signal S20 from the first source driver 21 to operate like the second source driver 25 of FIG. 3. Furthermore, the second source driver 40 produces a third writing start pulse signal S40 after the second source driving signal S12 is supplied to the last (e.g. mth) source line of the second panel 18. The third writing start pulse signal S40 is supplies to the following liquid crystal display unit (7 or 5). The following liquid crystal display unit receives the third writing start pulse signal S40 instead of the second writing start pulse signal s20 and operates as mentioned above regarding the liquid crystal displaying unit 5 or 7.

Furthermore, this invention is not limited to the system having the liquid crystal display panels. Other flat panel display may be used as far as raw and column lines are used in each panel.

What is claimed is:

1. A picture displaying method for displaying a picture by means of a plurality of picture displaying units each of which has a displaying panel driven with primary and secondary driving signals produced according to an input picture signal, said method comprising the steps of:

supplying the input picture signal to each of the picture displaying units in a parallel manner so that the picture displaying units receive the same signal as the input picture signal;

starting, in a first displaying unit which is one of the picture displaying units, producing first primary and first secondary driving signals according to the input picture signal;

starting, in a second displaying unit which is another one of the picture displaying units, producing one of second primary and second secondary driving signals according to the input picture signal;

driving a first displaying panel of the first displaying unit with the first primary and the first secondary driving signals to display a first part of the picture represented by the input picture signal;

sending a start pulse signal produced by a driver which produces one of the first primary and the first secondary driving signals in the first displaying unit to the second displaying unit after the one of the first primary and the first secondary driving signals is produced by the driver to display the first part of the picture;

starting, in the second displaying unit, producing the other of the second primary and the second secondary driving signals in response to the start pulse signal; and driving a second displaying panel of the second displaying unit with the second primary and the second secondary driving signals to display a second part, which is different from the first part, of the picture represented by the input picture signal.

2. A picture displaying method claimed in claim 1, wherein the first and the second primary driving signals comprise gate driving signals while the first and the second secondary driving signals comprise source driving signals.

3. A picture displaying method claimed in claim 1, wherein the first and the second primary driving signals comprise source driving signals while the first and the second secondary driving signals comprise gate driving signals.

4. A picture displaying method claimed in claim 1, further comprising the steps of:

producing, in a third displaying unit which is still another one of the picture displaying units, one of third primary and third secondary driving signals according to the input picture signal;

sending an additional start pulse signal produced by another driver which produces one of the second primary and the second secondary driving signals in the second displaying unit to the third displaying unit after the one of the second primary and the second secondary driving signals are produced by the other driver to display the second part of the picture;

starting, in the third displaying unit, producing the other of the third primary and the third secondary driving signals according to the picture signal in response to the additional start pulse signal; and driving a third displaying panel of the third displaying unit with the third primary and the third secondary driving signals to display a third part, which is different from both of the first part and the second part, of the picture represented by the input picture signal.

5. A picture displaying system comprising:

a plurality of picture displaying units each of which has a displaying panel driven with primary and secondary driving signals produced according to an input picture signal;

wherein the input picture signal is supplied to each of the picture displaying units in a parallel manner so that the picture displaying units receive the same signal as the input picture signal;

and wherein a first picture displaying unit which is one of the picture displaying units starts producing first primary and first secondary driving signals according to the input picture signal, drives a first displaying panel thereof with the first primary and the first secondary driving signals to display a first part of a picture represented by the input picture signal, and then sends a start pulse signal produced by a driver which produces one of the first primary and the first secondary driving signals in the first picture displaying unit to a second picture displaying unit which is another one of the picture displaying units after the one of the first primary and the first secondary driving signals is produced by the driver to display the first part of the picture;

and wherein the second picture displaying unit starts producing one of second primary and second secondary driving signals according to the input picture signal, and starts producing the other of the second primary and the second secondary driving signals according to the picture signal in response to the start pulse signal sent from the driver of the first picture displaying unit, and drives a second displaying panel thereof with the second primary and the second secondary driving signals to display a second part, which is different from the first part, of the picture represented by the input picture signal.

6. A picture displaying system claimed in claim 5, wherein the first and the second primary driving signals comprise gate driving signals while the first and the second secondary driving signals comprise source driving signals.

7. A picture displaying system claimed in claim 5, wherein the first and the second primary driving signals comprise source driving signals while the first and the second secondary driving signals comprise gate driving signals.

8. A picture displaying system claimed in claim 5, wherein the second picture displaying unit sends an additional start pulse signal produced by another driver which produces one of the second primary and the second secondary driving signals in the second picture display unit to a third picture displaying unit which is still another one of the picture displaying units after the one of the second primary and the second secondary driving signals is produced by the other driver to display the second part of the picture, and wherein the third picture displaying unit starts producing one of third primary and third secondary driving signals according to the input picture signal, and starts producing the other of the third primary and the third secondary driving signals according to the input picture signal in response to the additional start pulse signal sent from the other driver of the second picture displaying unit, and drives a third displaying panel thereof with the third primary and the third secondary driving signals to display a third part, which is different from both of the first part and the second part, of the picture represented by the input picture signal.

9. A picture displaying unit comprising:

a start pulse signal producing circuit for producing start pulse signals to start producing first primary and first secondary driving signals according to an input picture signal directly received from a signal source;

primary and secondary driver circuits for producing the first primary and the first secondary driving signals in response to the start pulse signals; and a displaying panel for being driven with the first primary and the first secondary driving signals to display a first part of a picture represented by the input picture signal;

wherein the primary driver circuit sends, after producing the first primary driving signal, an additional start pulse signal to another picture displaying unit which receives the input picture signal directly from the signal source to start producing one of second primary and second secondary driving signals which are used for displaying a second part of the picture.

10. A picture displaying unit claimed in claim 9, wherein the first primary driving signal comprises a gate driving signal or a source driving signal while the first secondary driving signal comprises the source driving signal or the gate driving signal.

11. A picture displaying unit comprising:

a start pulse signal producing circuit for producing an internal start pulse signal to start producing a primary driving signal according to an input picture signal directly received from a signal source;

a primary driver circuit for producing the primary driving signal in response to the internal start pulse signal;

a secondary driver circuit for receiving an external start pulse signal from another picture displaying unit which receives the input picture signal directly from the signal source and displays a first part of a picture represented by the input picture signal to produce a secondary driving signal after the first part of the picture is displayed by the other picture displaying unit;

a displaying panel driven with the primary and the secondary driving signals for displaying a second part of a the picture.

12. A picture displaying unit claimed in claim 11, wherein the primary driving signal comprises one of a gate driving signal and a source driving signal while the secondary driving signal comprises the other of the gate driving signal and the source driving signal.

13. A picture displaying unit comprising:

a start pulse signal producing circuit for producing an internal start pulse signal to start producing a primary driving signal according to an input picture signal directly received from a signal source;

a primary driver circuit for producing the primary driving signal in response to the internal start pulse signal;

a secondary driver circuit for receiving an external start pulse signal from a preceding picture displaying unit which receives the input picture signal directly from the signal source and displays a first part of a picture represented by the input picture signal to produce a secondary driving signal after the first part of picture is displayed by the preceding picture displaying unit and for producing another external start pulse signal to be supplied to a following picture displaying unit after producing the secondary driving signal;

a displaying panel driven with the primary and the secondary driving signals for displaying a second part of the picture represented by the input picture signal.

14. A picture displaying unit claimed in claim 13, wherein the primary driving signal comprises one of a gate driving signal and a source driving signal while the secondary driving signal comprises the other of the gate driving signal and the source driving signal.

15. A picture displaying method for displaying a picture represented by an input picture signal by means of a plurality of picture displaying units, said method comprising the steps of:

supplying the input picture signal to each of the picture displaying units in a parallel manner so that the picture displaying units receive the same signal as the input picture signal;

displaying a first part of the picture according to the picture signal by means of a first picture displaying unit which is one of the picture displaying units;

sending a start signal, after displaying of the first part of the picture, from a driver which is provided in the first picture displaying unit and which produces one of the first primary and first secondary driving signals for displaying the first part of the picture to a second picture displaying unit which is another one of the picture displaying units; and displaying a second part different from the first part of the picture according to the picture signal in response to the start signal by means of the second picture displaying unit.

16. A picture displaying method claimed in claim 15, further comprising the steps of:

sending an additional start signal, after displaying of the first part of the picture, from another driver which is provided in the second picture displaying unit and which produces one of the second primary and second secondary driving signals for displaying the second part of the picture to a third picture displaying unit which is still another one of the picture displaying units; and displaying a third part different from the first and the second parts of the picture according to the picture signal in response to the additional start signal by means of the third picture displaying unit.

17. A picture displaying system for displaying a picture represented by a picture signal received from a signal source, the system comprising:

a first picture displaying unit for receiving the picture signal to display a first part of the picture and to produce a start signal by means of a driver which produces one of the first primary and first secondary driving signals used for displaying the first part of the picture after displaying the first part of the picture; and a second picture displaying unit for receiving both of the picture signal and the start signal to display a second part different from the first part of the picture, wherein the first picture displaying unit and the second displaying unit receive the picture signal from the signal source in a parallel manner whereby the first picture displaying unit and the second picture displaying unit receive the same signal as the picture signal.

18. A picture displaying system claimed in claim 17, wherein the second picture displaying unit produces an additional start signal by means of another driver which produces one of second primary and secondary driving signals used for displaying the second part of the picture after displaying the second part of the picture; and wherein the system further comprises a third picture displaying unit for receiving both of the picture signal and the additional start signal to display a third part different from both of the first and the second parts of the picture.

* * * * *